US005862793A

United States Patent [19]

Jay et al.

[11] Patent Number: 5,862,793

[45] Date of Patent: Jan. 26, 1999

[54] INJECTION VALVE ARRANGEMENT

[75] Inventors: David C. Jay, Vähäkyrö ; Erkko Fontell, Vaasa, both of Finland

[73] Assignee: Wartsila Diesel International Ltd Oy, Helsinki, Finland

[21] Appl. No.: 911,631

[22] Filed: Aug. 15, 1997

[30] Foreign Application Priority Data

Aug. 16, 1996 [FI] Finland ..... 963229

[51] Int. Cl.[6] ..... F02M 37/04

[52] U.S. Cl. ..... 123/467; 239/96; 123/299; 123/25 C

[58] Field of Search ..... 123/1 A, 299, 123/300, 467, 447, 575, 576, 578, 25 C, 25 E; 239/533, 585, 88–96

[56] References Cited

U.S. PATENT DOCUMENTS

| | | | |
|---|---|---|---|
| 5,048,489 | 9/1991 | Fischer et al. | 123/467 |
| 5,551,634 | 9/1996 | Raab et al. | 239/96 |
| 5,647,316 | 7/1997 | Hellen et al. | 123/299 |
| 5,671,715 | 9/1997 | Tsuzuki | 123/467 |
| 5,758,618 | 6/1998 | Jay et al. | 123/299 |

FOREIGN PATENT DOCUMENTS

| | | |
|---|---|---|
| 0 431 272 | 6/1991 | European Pat. Off. . |
| 0 718 489 | 6/1996 | European Pat. Off. . |
| 35 40 780 | 5/1987 | Germany . |

*Primary Examiner*—Thomas N. Moulis
*Attorney, Agent, or Firm*—Smith-Hill and Bedell

[57] ABSTRACT

An injection valve arrangement for injecting a pressure medium into a combustion chamber of an internal combustion engine comprises a valve body formed with a feed duct and an actuation chamber, and an elongated valve member fitted in the valve body and movable in the valve body between an open position and a closed position. The valve member is formed with an internal chamber which is in communication with the feed duct and is also formed with one or more nozzle orifices which provide fluid communication between the internal chamber and the combustion chamber when the valve member is in the open position. The valve member has a piston surface bounding the actuation chamber such that force acting on the valve member due to pressure in the actuation chamber urges the valve member toward its open position against the force of a spring. A control valve controls feeding of pressure medium to the actuation chamber, so that when the control valve is open, supply of pressure medium to the actuation chamber causes an increase in pressure in the actuation chamber.

19 Claims, 3 Drawing Sheets

20
19
15b
21
16
15
15a
11
8b
14
17
13
12
8
18
10
7
2
9
4
5
8a
1
28
29a
29b
6a
6b
3

20
19
15b
16
15
21
15a
18a
11
25
26
24
8d
22b
22a
8
8c
22
23
14
12
18
17
8a
10
7
2
9
4
5
8a
1
28
29a
29b
6a
6b
3

20
19
15b
16
15
21
15a
18a
26
24
25
27
11
18
8d
22
22a
23
8c
8
12
14
17
8a
7
10
2
9
4
5
8a
1
28
29a
29b
6a
6b
3

INJECTION VALVE ARRANGEMENT

BACKGROUND OF THE INVENTION

The invention relates to an injection valve arrangement.

Different injection solutions with electronic control are known for injecting different auxiliary or supplementary substances such as water, fluid ammonia (such as liquid ammonia or an aqueous solution of ammonia), urea or the like into the combustion chamber of an engine in order to influence the combustion process so that as a consequence thereof the quantity of harmful substances such as oxides of nitrogen, NOx, created would be less than without injection of these auxiliary substances. Complicated construction and space requirements are problems in these known solutions, which is particularly due to the fact that oil is used as a pressure medium for controlling the injection and sealing arrangements must be provided to prevent mixing of oil and the auxiliary substance.

SUMMARY OF THE INVENTION

An aim of the invention is to create a new solution, which is suitable for the injection of a pressure medium and from which the problems mentioned above and related to the known technique have been eliminated. A further aim is to provide a solution suitable especially for the injection of water or a corresponding auxiliary substance and which is structurally simple and compact and reliable as to its operation.

According to the invention, the pressure in the actuation chamber urges the elongated valve member toward its open position, against the force of the spring. The control valve controls feeding of the pressure medium into the actuation chamber so that the movement of the control valve to the open position causes an increase in pressure in the actuation chamber and thus movement of the elongated valve member towards the combustion chamber of the cylinder to an open position allowing injection. It is advantageous if the pressure medium to be injected into the cylinder is the same as the pressure medium used to control the injection thereof, because then no special sealing of the elongated valve member to the valve body between the actuation chamber and the internal chamber of the valve member is needed. Since the elongated valve member of the injection valve is pushed towards the combustion chamber of the cylinder for opening the injection valve, i.e. the injection valve is of the so-called poppet valve type, the nozzle orifices of the injection valve remain protected from the exhaust gases except during the injection phase of the operating cycle and, thus, can better be kept clean.

The valve body is advantageously formed with a control valve chamber and the control valve comprises a valve member located in the control valve chamber and spring-loaded towards its closing position.

Advantageously there is a first throttle aperture for feeding the pressure medium into the actuation chamber and the actuation chamber is connected through a second throttle aperture to a drain passage. The control of the changes of pressure in the actuation chamber can be effected in a simple way by making the area of the first throttle aperture substantially greater than the area of the second throttle aperture, and preferably the proportion of their areas is about 7:1. In practice the area of the first throttle aperture can be quite large, in other words of the same order as for example the cross-sectional area of the feed duct through which the pressure medium is fed into the internal chamber of the injection valve member.

In an advantageous embodiment the pressure medium is fed continuously into the control valve chamber, i.e. the feed duct has a branch connected to the control valve chamber and the pump supplying the pressure medium operates continuously and pressure is continuously maintained in the feed duct. The control valve chamber is connected to the actuation chamber via the first throttle aperture, whereby in its closed position the valve member of the control valve closes the connection of the control valve chamber to the actuation chamber.

In another advantageous embodiment the pressure medium is not fed continuously into the control valve chamber but the arrangement comprises an auxiliary valve controlled by the control valve for closing the connection from the pressure medium feed duct through the first throttle aperture to the actuation chamber. When the first throttle aperture is closed, the elongated valve member is urged to its closed position.

The auxiliary valve comprises with advantage an auxiliary valve member in an auxiliary valve chamber which is connectable under the control of the auxiliary valve and through the first throttle aperture to the actuation chamber. The pressure medium is continuously fed into the auxiliary valve chamber.

In this embodiment the valve body further includes with advantage an auxiliary valve actuation chamber, into which the pressure medium is fed continuously through a third throttle aperture and which is connectable through a fourth throttle aperture to the drain passage. The pressure in the auxiliary valve actuation chamber urges the auxiliary valve member in the closing direction of the auxiliary valve. Then the control valve can with advantage be arranged to control the connection of the auxiliary valve actuation chamber to the drain passage.

The area of the fourth throttle aperture is with advantage substantially greater than the area of the third throttle aperture, and preferably the proportion of their areas is about 5:1. Due to the third throttle aperture, only one feeding means for the pressure medium is needed and by appropriately choosing the areas of the throttle apertures, the pressure in the auxiliary valve actuation chamber can advantageously be controlled.

To ensure the closing of the auxiliary valve it can with advantage be spring-loaded towards its closing position.

The control valve is advantageously a solenoid valve, which receives an electric control signal from an electronic control unit dependent on the operation of the engine. Hereby the injection of the auxiliary substance can be controlled precisely.

The feed duct of the pressure medium is with advantage provided with a pressure control means upstream of the feed duct. In this way the safety of the construction and of the system and the reliability of operation can be ensured.

In practice the pressure medium can with advantage be water.

The valve body of the injection valve can with advantage be provided also with a separate fuel injection valve, the nozzle orifices of which are arranged at a different level in the axial direction of the cylinder from the nozzle orifices of the injection valve for the pressure medium. In this way a compact injection arrangement is created, by means of which the injection of both the fuel and the auxiliary substance into the cylinder can with advantage be provided.

BRIEF DESCRIPTION OF THE DRAWINGS

In the following the invention is described by way of example with reference to the accompanying drawings, in which.

DETAILED DESCRIPTION

Figure 1:
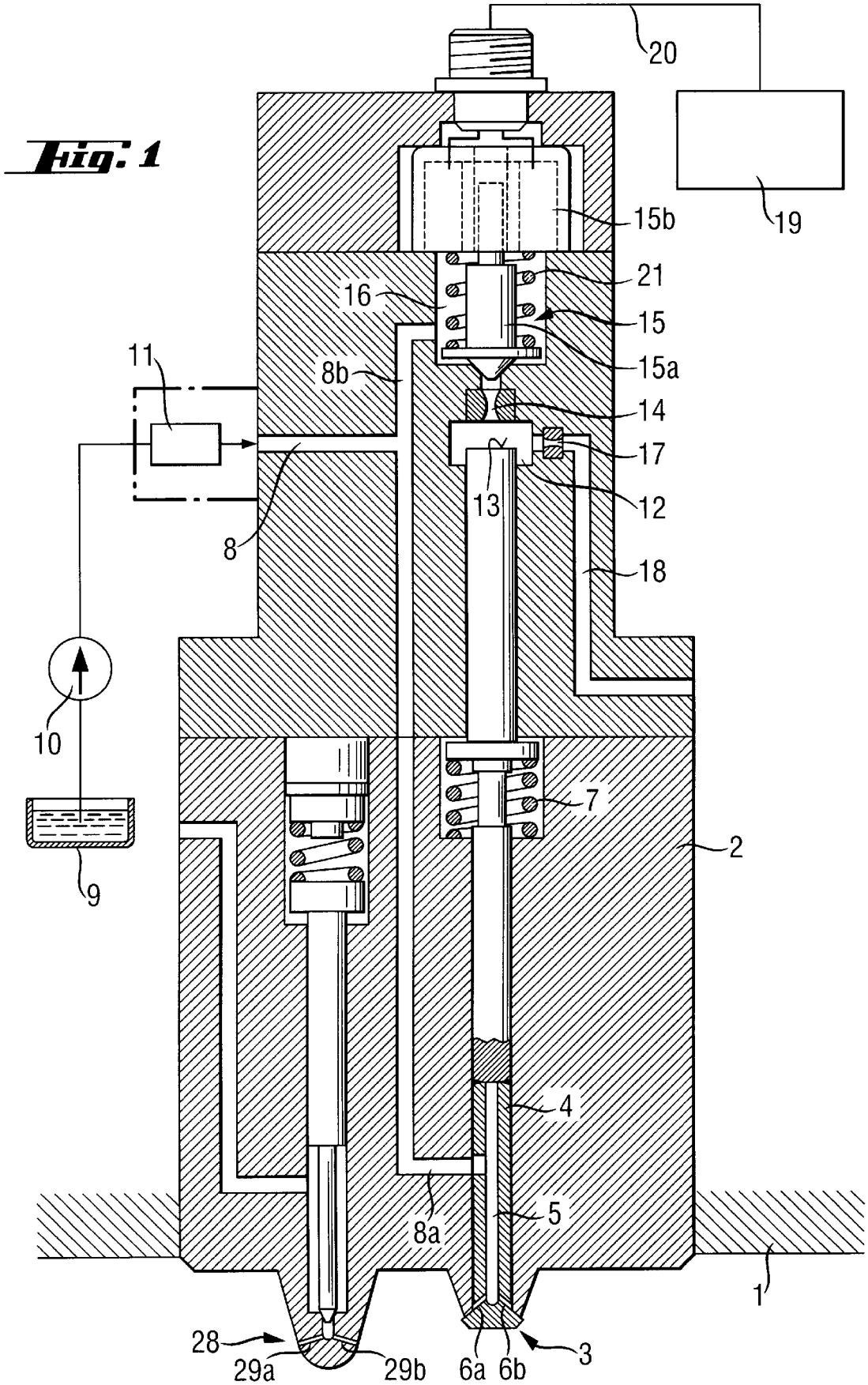
FIG. 1 shows an embodiment of the injection valve arrangement according to the invention in section.

In the drawings 1 indicates a cylinder head of an engine, which for its part bounds a combustion chamber of a cylinder not shown in more detail and to which a valve body 2 provided with an injection valve 3 is mounted. The injection valve 3 includes a valve member 4 enclosing a chamber 5, which is provided with one or more nozzle orifices 6*a*, 6*b* etc. The valve 3 is a so-called poppet valve, whereby the valve is opened by pushing the valve member 4 somewhat forward out from the valve body 2 into the combustion chamber of the cylinder, exposing the nozzle orifices 6*a*, 6*b* and enabling injection of the pressure medium in the chamber 5 through the nozzle orifices 6*a*, 6*b* into the combustion chamber of the cylinder. The valve member 4 is urged to its closed position, in which injection is prevented by virtue of the orifices 6*a*, 6*b* being blocked, by a spring 7. In the closed position, shown in FIG. 1, the valve body 2 protects the nozzle orifices 6*a*, 6*b* from the exhaust gases in the cylinder. In the following the pressure medium is presumed to be water.

The water to be injected into the cylinder is fed from a container 9 by a pump 10 which feeds the water continuously to a feed duct 8 and further through its branch 8*a* into the chamber 5. A so-called flow fuse 11 is arranged between the pump 10 and the feed duct 8 for detecting changes in flow pressure and it affects the flow when necessary. For example, the flow fuse 11 stops the feeding of water if the valve member 4 gets stuck so that it will not totally close. On the other hand when the injection begins, the pressure tends to decrease, whereby the flow fuse 11 can be arranged to provide a pressure pulse so that in that case the pressure will not fall below the desired injection pressure by more than 30 bar, for example.

The valve body 2 includes a second chamber 12, the pressure in which affects the valve member 4 through a surface 13. Since the spring force of the spring 7 normally exceeds the force acting on the valve body due to the pressure prevailing in the chamber 12, the valve member 4 remains in its closed position and no injection of water into the cylinder occurs.

The feed duct 8 can be connected to the chamber 12 through a throttle aperture 14. The control valve 15 includes a valve member 15*a* located in a chamber 16 of the valve body 2. In this manner, the pressure of the water in the feed duct can be communicated to the chamber 12. Further, the chamber 12 is connected through a throttle aperture 17 to a drain passage 18, through which water can be led back into the container 9.

The control of the valve member 15*a* of control valve 15 takes place by solenoid means 15*b* included in the control valve, the operation of which is controlled by signals 20 provided by an electronic control unit 19. The control unit 19 can be preprogrammed in a way known as such to provide timely control signals in accordance with the working cycle of the engine, for example on the basis of signals from a sensor following the rotation of the crankshaft of the engine. When there is no current in the solenoid means 15*b*, a spring 21 urges the valve member 15*a* to its closed position, in which the valve 15 closes the connection of the chamber 12 through the throttle aperture 14 to the feed duct 8.

In the embodiment of FIG. 1 a branch 8*b* of the feed duct 8 is directly connected to the chamber 16, whereby the valve member 15*a* of the control valve acts directly on the throttle aperture 14. When the control signal 20 connects current to the solenoid means 15*b*, the valve member 15*a* moves against the force of the spring 21 to its open position, in which the connection of the chamber 12 through the throttle aperture 14 to the chamber 16 and thus to the branch 8*b* of the feed duct opens. As a consequence the pressure in the chamber 12 increases so much that the valve member 4 of the injection valve 3 moves to the open position against the force of the spring 7, whereby injection of water occurs through the nozzle orifices 6*a*, 6*b* from the chamber 5 into the combustion chamber of the cylinder. Since the throttle aperture 14 is substantially larger than the throttle aperture 17, when the control valve 15 opens the pressure in the chamber 12 increases fast enough and to a sufficient extent to cause injection. In practice the proportion of the areas of the throttle apertures 14 and 17 can typically be for example 7:1.

When the control unit 19 disconnects current from the solenoid means 15*b*, the spring 21 urges the valve member 15*a* to its closed position, closing the valve 15. Since the chamber 12 is continuously connected through the throttle aperture 17 to the drain passage 18, the pressure in the chamber 12 decreases then so much that the spring 7 urges the valve member 4 of the injection valve to its closed position, whereby the injection ends.

Figure 2:
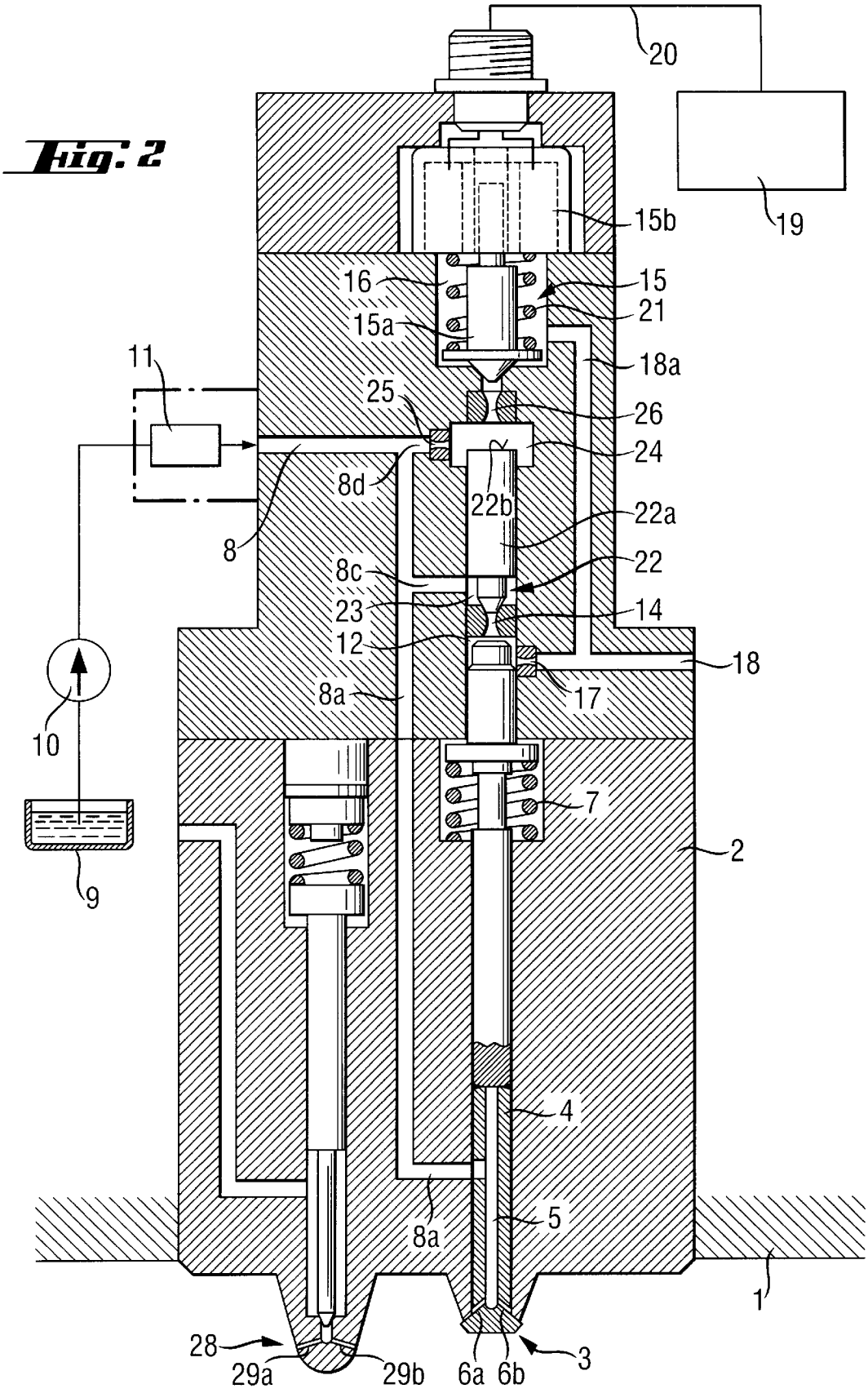
FIG. 2 shows another embodiment of the injection valve arrangement according to the invention in section.

In the embodiment of FIG. 2 the control valve 15 does not influence the pressure in the chamber 12 directly but through an auxiliary valve 22. For this purpose, the valve body 2 includes a fourth chamber 23, the connection of which to the chamber 12 through the throttle aperture 14 is controlled by the valve member 22*a* of the auxiliary valve. The feed duct 8 is connected through its branch 8*c* continuously to the chamber 23. In addition the arrangement includes a fifth chamber 24 which is connected to the feed duct 8 through its branch 8*d* and a throttle aperture 25. The pressure in the chamber 24 acts on the valve member 22*a* of the auxiliary valve 22 through its surface 22*b*. In addition the chamber 24 is connectable under the control of the valve member 15*a* of the control valve to the chamber 16 through a throttle aperture 26. In this embodiment the chamber 16 is connected to the drain passage 18 through the branch 18*a*.

When the control signal 20 given by the control unit 19 connects current to the solenoid means 15*b*, the valve member 15*a* moves against the force of the spring 21 to a position in which the connection of the chamber 24 to the chamber 16 through the throttle aperture 26 opens. Then the pressure in the chamber 24 decreases, since the throttle aperture 26 is selected suitably larger than the throttle aperture 25. In practice the proportion of the areas of the throttle apertures 26 and 25 can typically be for example 5:1. As a consequence the valve member 22*a* moves upwards in FIG. 2 and the auxiliary valve 22 opens, whereby the connection of the chamber 12 through the throttle aperture 14 to the chamber 23 opens and the pressure of the water in the feed duct 8 is communicated to the chamber 12 through the branch 8*c* and forces the valve member 4 of the injection valve downward in the figure to its open position, allowing injection. Correspondingly when the current is disconnected from the solenoid means 15*b*, the control valve 15 closes and the pressure in the chamber 24 rises and closes the auxiliary valve 22. As a consequence of this the pressure in the chamber 12 decreases, since the connection of the chamber 12 to the drain passage 18 is continuously open through the throttle aperture 17, whereby the spring 7 urges the valve member 4 of the injection valve to its closed position and the injection ends.

Figure 3:
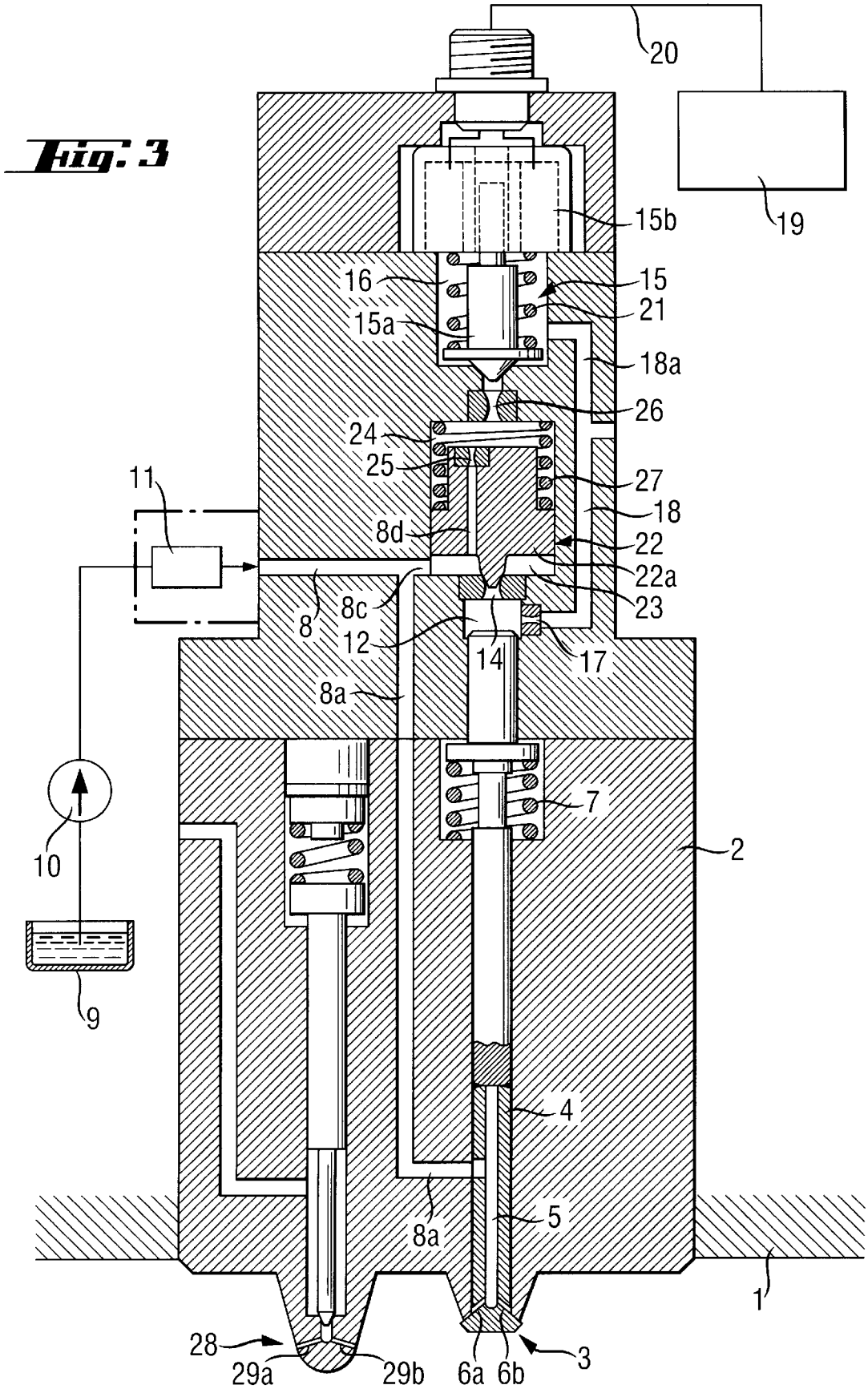
FIG. 3 shows a third embodiment of the injection valve arrangement according to the invention in section.

The embodiment of FIG. 3 differs from the embodiment of FIG. 2 mainly by use of a spring 27 to ensure the closing of the auxiliary valve 22. In addition the branch 8*d* feeding water into the chamber 24 is formed by a bore in the valve member 22*a* and is connected to the feed duct 8 by way of the branch 8*c* and the chamber 23. Operationally the embodiments of FIGS. 2 and 3 correspond to each other.

When the throttle apertures 25 and 26 are used to control the pressure in the chamber 24, a smaller force of the spring 21 is needed and a more compact design is achieved. On the other hand, the use of a separate auxiliary valve 22 makes the design as such more complicated than the embodiment of FIG. 1, in which for its part a considerably stronger solenoid is needed, which requires more space.

When both the pressure medium to be injected and the pressure medium of the control valve are the same, in other words advantageously water, there is no need for special sealing of the valve member 4, for example between the chambers 5 and 12. On the other hand the nature of the pressure medium supplied to the control valve must be taken into consideration when selecting materials for the solenoid means 15*b* as well as when designing their operating environment.

A compact design is obtained if the actual fuel injection valve 28 with its nozzle apertures 29*a*, 29*b* etc. is integrated into the valve body 2 of the injection valve. Then the injection of the fuel and of the auxiliary substance can easily be mutually arranged so that an optimal result is obtained from the viewpoint of combustion and the harmful additional substances created as a consequence thereof.

The invention can also be applied so that different feeding means, for example separate pumps and feed ducts are utilized to feed the pressure medium to be injected and the pressure medium of the control valve, respectively. This kind of a solution would be suitable particularly in connection with the embodiment of FIG. 1, whereby a relatively weaker solenoid could be used, but in other respects the solution would be considerably more complicated.

The invention is not restricted to the embodiments shown, but several modifications are feasible within the scope of the attached claims.

We claim:

1. An injection valve arrangement for injecting a pressure medium into a combustion chamber of an internal combustion engine, the arrangement comprising:

a valve body formed with a feed duct and an actuation chamber, an elongated valve member fitted in the valve body and movable in the valve body between an open position and a closed position, the valve member being formed with an internal chamber which is in communication with the feed duct and being also formed with at least one nozzle orifice which provides fluid communication between the internal chamber and the combustion chamber when the valve member is in the open position, the valve member having a piston surface bounding said actuation chamber such that force acting on the valve member due to pressure in the actuation chamber urges the valve member toward its open position, a spring urging the valve member toward its closed position, and a control valve for controlling feeding of pressure medium to said actuation chamber, so that when the control valve is open, supply of pressure medium to the actuation chamber causes an increase in pressure in the actuation chamber.

2. An injection valve arrangement according to claim 1, wherein the valve body is formed with a control valve chamber and the control valve comprises a control valve member located in the control valve chamber and spring-biased toward a closed position.

3. An injection valve arrangement according to claim 2, comprising a means defining a first throttle aperture for feeding pressure medium into the actuation chamber and a second throttle aperture connecting the actuation chamber to a drain passage.

4. An injection valve arrangement according to claim 3, wherein the area of the first throttle aperture is substantially greater than the area of the second throttle aperture.

5. An injection valve arrangement according to claim 4, wherein the area of the first throttle aperture is approximately seven times the area of the second throttle aperture.

6. An injection valve arrangement according to claim 4, wherein the control valve chamber is connected to the feed duct, the first throttle aperture connects the control valve chamber to the actuation chamber and the control valve member closes the first throttle aperture when the control valve is opened.

7. An injection valve arrangement according to claim 4, comprising an auxiliary control means controlled by the control valve for closing the connection from the feed duct through the first throttle aperture to the actuation chamber.

8. An injection valve arrangement according to claim 7, wherein the valve body is formed with an auxiliary valve chamber connected to the feed duct and said auxiliary control means comprises an auxiliary valve which includes an auxiliary valve member movable in the auxiliary valve chamber between an open position in which it allows pressure medium to flow from the auxiliary valve chamber through the first throttle aperture to the actuation chamber and a closed position in which it blocks the first throttle aperture.

9. An injection valve arrangement according to claim 8, wherein the valve body is formed with an auxiliary valve actuation chamber which is connected through a third throttle aperture to the feed duct and through a fourth throttle aperture to the drain passage, the auxiliary valve member has a piston surface bounding the auxiliary valve actuation chamber, and the force acting on the auxiliary valve member due to pressure in the auxiliary valve actuation chamber urges the auxiliary valve member toward its closed position.

10. An injection valve arrangement according to claim 9, wherein the control valve controls connection of the auxiliary valve actuation chamber to the drain passage.

11. An injection valve arrangement according to claim 9, wherein the area of the fourth throttle aperture is substantially greater than the area of the third throttle aperture.

12. An injection valve arrangement according to claim 11, wherein the area of the fourth throttle aperture is approximately five times the area of the third throttle aperture.

13. An injection valve arrangement according to claim 8, wherein the auxiliary valve member is spring-loaded toward its closed position.

14. An injection valve arrangement according to claim 1, wherein the control valve is a solenoid valve.

15. An injection valve arrangement according to claim 14, further comprising an electronic control unit for providing an electric control signal to the solenoid valve dependent on operation of the engine.

16. An injection valve arrangement according to claim 1, comprising a pressure control means for controlling pressure at which the pressure medium is supplied to the feed duct.

17. An injection valve arrangement according to claim 1, comprising a means for supplying water to the feed duct as the pressure medium.

18. An injection valve arrangement according to claim 1, wherein a fuel injection valve member is fitted in the valve body and the valve body is formed with fuel injection nozzle orifices at a different axial position from the nozzle orifice of said elongated valve member.

19. An injection valve arrangement according to claim 1, wherein the actuation chamber is in communication with the feed duct, whereby the pressure medium fed to the actuation chamber is the same as the pressure medium fed to the internal chamber of the elongated valve member.

* * * * *